US011082766B1

(12) United States Patent
Bar Lev

(10) Patent No.: US 11,082,766 B1
(45) Date of Patent: Aug. 3, 2021

(54) DEVICE FOR HOLDING AN EARPHONE IN AN EAR

(71) Applicant: FLYING HIPPO LLC, Brookline, MA (US)

(72) Inventor: Raphael Bar Lev, Tel Aviv (IL)

( * ) Notice: Subject to any disclaimer, the term of this patent is extended or adjusted under 35 U.S.C. 154(b) by 0 days.

(21) Appl. No.: 17/203,806

(22) Filed: Mar. 17, 2021

Related U.S. Application Data

(63) Continuation of application No. 17/176,198, filed on Feb. 16, 2021.

(60) Provisional application No. 62/977,307, filed on Feb. 16, 2020.

(51) Int. Cl.
*H04R 1/10* (2006.01)

(52) U.S. Cl.
CPC ..... *H04R 1/105* (2013.01)

(58) Field of Classification Search
CPC ..... H04R 1/10; H04R 1/105; H04R 1/1016; H04R 1/1066
See application file for complete search history.

(56) References Cited

U.S. PATENT DOCUMENTS 5,881,161 A * 3/1999 Liu ..... H04R 1/1066 381/381
5,927,659 A * 7/1999 Yang ..... H04R 1/105 248/58
6,047,076 A * 4/2000 Yang ..... H04R 1/1066 181/129
2012/0230532 A1* 9/2012 Howell ..... H04R 1/1066 381/381
2016/0381448 A1* 12/2016 Qian ..... H04R 1/105 381/74
2020/0154196 A1* 5/2020 Kolton ..... H04R 1/105

* cited by examiner

*Primary Examiner* — Thang V Tran
(74) *Attorney, Agent, or Firm* — AlphaPatent Associates, Ltd; Daniel J. Swirsky

(57) ABSTRACT

A device having a first anchor portion adjacent to a second anchor portion, where the first and second anchor portions are separated by a retaining portion, where the device is configured for positioning on an ear, where the retaining portion is configured to prevent egress of an earphone positioned in or on the ear when the device is positioned on the ear.

16 Claims, 8 Drawing Sheets

DEVICE FOR HOLDING AN EARPHONE IN AN EAR

CROSS REFERENCE TO RELATED APPLICATIONS

This application is a continuation of U.S. patent application Ser. No. 17/176,198, filed Feb. 16, 2021, which claims priority from U.S. Provisional Patent Application No. 62/977,307, filed Feb. 16, 2020, which is incorporated herein by reference in its entirety.

FIELD

The invention relates to accessories for earphones generally, and more particularly to a flexible holder for an earphone.

BACKGROUND

Earbud earphones and in-ear earphones are very commonly used such as for hands-free cellphone use and for listening to audio material in multimedia content (music, videos) on devices such as PCs, smartphones, and digital audio players. These earphones may be wired or wireless. Many people may use earphones while exercising or performing other activities with intensive movements. Very often earphones fall out of ears while in use—particularly during such activities with intensive movements. Sometimes the fallen earphones can be picked up but often the fallen earphones cannot be retrieved. Earphones are especially liable to fall out during exercising, such as when running, due to the impact from the activity and/or because of sweating.

One approach used for keeping the earphones in position on or in the ear relies on a holding element integrated into the earphone structure, where the holding element clips onto some part of the ear, rests on the outer ear or is wedged into the concha of the ear. Such an approach has the disadvantage that the holding element increases the size of the earphone and also the size of a related earphone storage and/or charging container.

A further approach relies on an earphone accessory with a holding element that needs to be attached to the earphone. Such an approach has the disadvantage that the accessory needs to be attached and detached from the earphone with almost every usage.

SUMMARY

This disclosure describes systems and methods for keeping earphones on or in an ear. The invention, in embodiments thereof, addresses the shortcomings of known configurations by providing a holder embodied as two adjacent anchors portions with a central retaining portion. The holder is configured to be worn on the ear, over any type of earphone. In some embodiments, the retaining portion is so positioned as to prevent egress of an earphone. In some embodiments, the retaining portion may exert pressure on a portion of the earphone in the direction of the ear canal to thereby hold the earphone in place. Advantageously, the holder does not need to be attached to the earphone.

When using a wired earphone, the earphone is first threaded through one of the apertures formed in the anchor portions and the holder is then positioned onto the ear. Alternatively, the holder can first be positioned onto the ear and then the earphone inserted under the retaining portion of the holder, and into the desired position.

The term "earphone" is used herein to refer to all the types of earphones and earpieces including wired and wireless in-ear headphones (or "in-ears") that are partially or fully inserted into the ear canal, or "ear-buds" that rest in/on the outer ear outside the ear canal.

In some embodiments, a device includes a first anchor portion, a second anchor portion, and a retaining portion, where the device is configured for positioning on an ear over an earphone placed in or on the ear, where the retaining portion is configured to prevent egress of the earphone when the device is positioned on an ear. In some embodiments, the retaining portion is configured to exert pressure on the earphone in the direction of an ear canal when the device is positioned on an ear.

In some embodiments, the first anchor portion is configured to fit over a helix of an ear, and where the second anchor portion is configured to fit over a lobule of the ear. In some embodiments, the device further includes a material of sufficient elasticity such that both of first and second anchor portions may be stretched or bent to fit over one or more portions of an ear. In some embodiments, the material is sufficiently rigid such that the device remains on the ear when both of first and second anchor portions are placed in this manner.

In some embodiments, the device further includes a substantially rigid material such that different portions of an ear may be bent to extend through first and second anchor portions. In some embodiments, the device includes an elastic material. In some embodiments, the device further includes an indentation. In some embodiments, the indentation extends through the device to define an aperture.

In some embodiments, an aperture extends across one of the first anchor portion, the second anchor portion, or the retaining portion to form a break. In some embodiments, the device further includes a protrusion. In some embodiments, the device is substantially identical on both sides. In some embodiments, the device is not identical on both sides.

In some embodiments, the first anchor portion and the retaining portion define a first aperture, where the second anchor portion and retaining portion define a second aperture. In some embodiments, the first aperture has a substantially bent teardrop shape. In some embodiments, the second aperture has a substantially circular shape. In some embodiments, the first or second aperture may accommodate a wire of a wired earphone. In some embodiments, the device includes one or more of silicone, latex or spandex.

This overview is provided to introduce a selection of concepts in a simplified form that are further described below in the Technical Disclosure. It may be understood that this overview is not intended to identify key features or essential features of the claimed subject matter, nor is it intended to be used to limit the scope of the claimed subject matter. The details of one or more implementations are set forth in the accompanying drawings and the description below. Other features will be apparent from the description and drawings, and from the claims.

BRIEF DESCRIPTION OF THE DRAWINGS

Aspects, embodiments, and features disclosed herein will become apparent from the following detailed description when considered in conjunction with the accompanying drawings, in which.

DETAILED DESCRIPTION

Figure 1A:
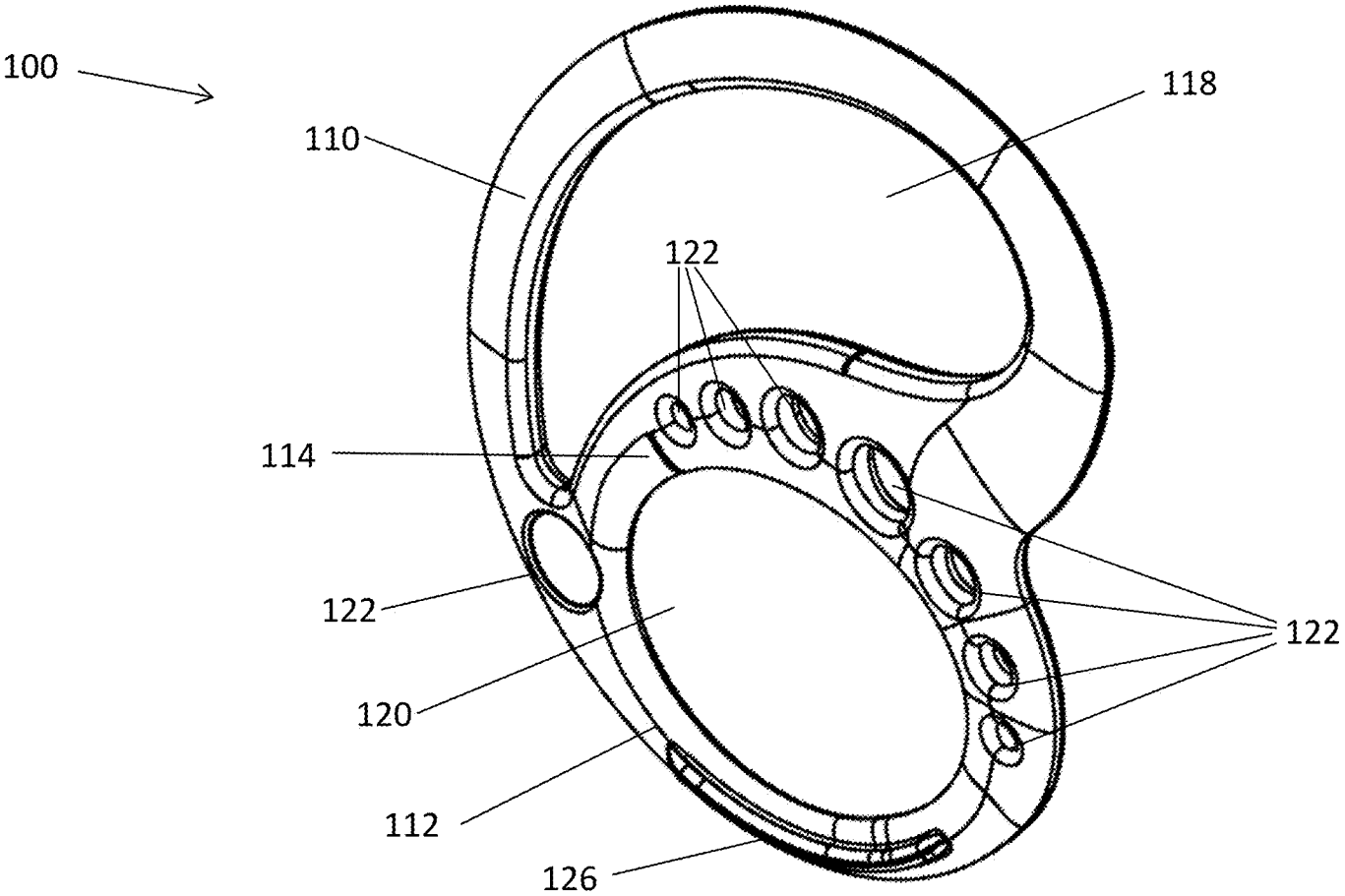
FIGS. 1A-1C show exemplary illustrations of an earphone holder according to some embodiments.

Reference will now be made in detail to non-limiting examples of this disclosure, examples of which are illustrated in the accompanying drawings. The examples are described below by referring to the drawings, wherein like reference numerals refer to like elements. When like reference numerals are shown, corresponding description(s) are not repeated, and the interested reader is referred to the previously discussed figure(s) for a description of the like element(s).

Figure 1B:
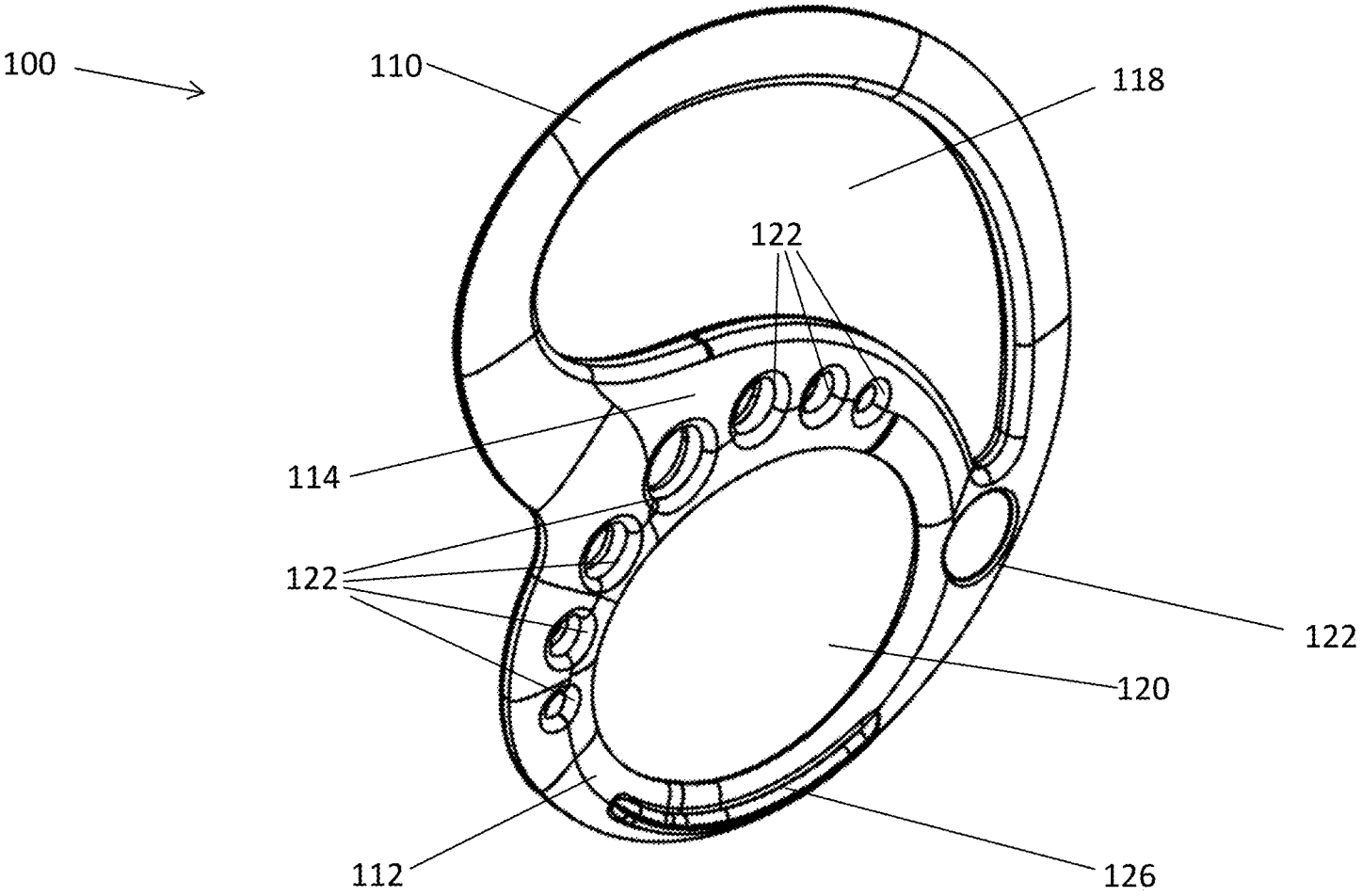
Figure 1C:
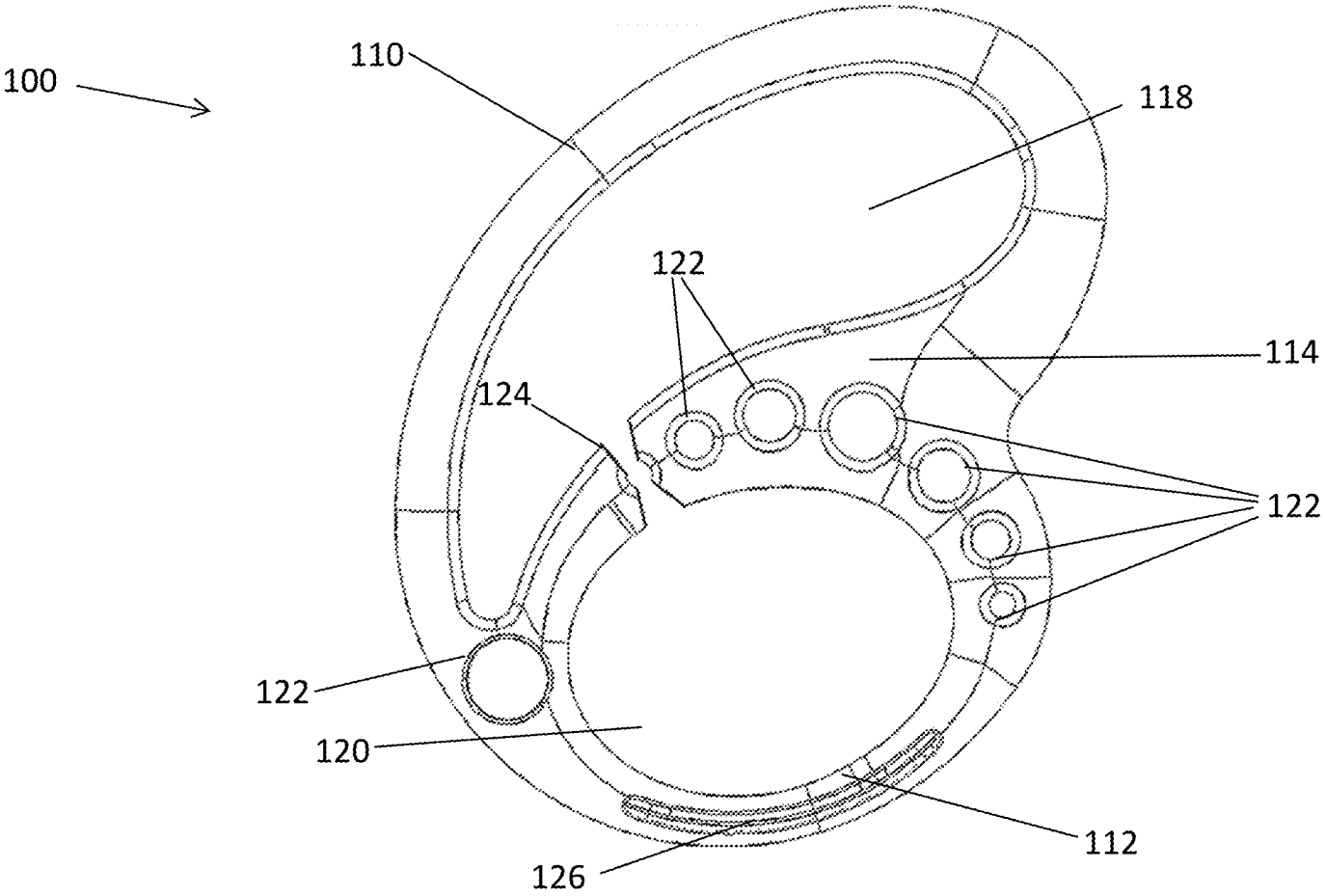

FIGS. 1A-1C show exemplary illustrations of an earphone holder according to some embodiments. As shown in FIGS. 1A-1C, an earphone holder 100 includes a first anchor portion 110, a second anchor portion 112 and a retaining portion 114. First anchor portion 110 may also be referred to herein as upper anchor portion 110 and second anchor portion 112 may be referred to herein as lower anchor portion 112. The terms "upper" and "lower" are used here in reference to the figures and to the disposition of the holder 100 when placed on an ear in an orientation as specified herein and are not intended to limit the structure or orientation of holder 100. Upper anchor portion 110 and lower anchor portion 112 are positioned adjacent to one another separated by retaining portion 114. In some embodiments, upper anchor portion 110, lower anchor portion 112 and retaining portion 114 are formed together. Upper anchor portion 110 and retaining portion 114 define an aperture 118. Lower anchor portion 112 and retaining portion 114 define an aperture 120.

In some embodiments, upper anchor portion 110 is sized and formed so as to fit around a portion of an upper ear to thereby anchor holder 100 to the upper ear. In some embodiments, lower anchor portion 112 is sized and formed so as to fit around a portion of the lower ear so as to anchor holder 100 to the lower ear. Retaining portion 114 is sized and positioned between upper anchor portion 110 and lower anchor portion 112 so as prevent egress of an earphone when holder 100 is positioned over the earphone on an ear.

In some embodiments, as shown in FIGS. 1A and 1B, aperture 118 has a substantially bent teardrop shape. In some embodiments, as shown in FIGS. 1A and 1B, aperture 120 has a substantially circular shape. The shapes and relative dimensions of anchor portions 110 and 112 and retaining portion 114 as shown in the figures are illustrative and should not be considered limiting.

In some embodiments, holder 100 is formed from an elastic material of sufficient elasticity so that one or both of anchor portions 110 and 112 may be stretched or bent to fit over one or more portions of an ear, where the material is also sufficiently rigid so that holder 100 remains in position once anchor portion 110 and/or anchor portion 112 are placed in this manner. For example, a portion of anchor portion 110 may be stretched or bent to fit over a first portion of an ear, such as the top (helix) of the ear, which then extends through aperture 118, and a portion of anchor portion 112 may be stretched or bent to fit over a second portion of the ear, such as the bottom (lobule) of the ear, which then extends through aperture 120. In some embodiments, holder 100 is formed from a substantially rigid material such that different portions of an ear may be bent to extend through apertures 118 and 120. In some embodiments, portions of holder 100 may be formed of a substantially rigid material while other portions are formed from an elastic material.

FIGS. 1A and 1B show alternate side perspective views of holder 100. In some embodiments, such as shown in FIGS. 1A and 1B, holder 100 is substantially identical on both sides. In some embodiments, holder 100 is not identical on both sides. In some embodiments, holder 100 is substantially flat on one or both sides.

In some embodiments, holder 100 includes one or more indentations 122. In some embodiments, one or more indentations 122 are provided to reduce the rigidity of portions of holder 100. In some embodiments, one or more indentations 122 fully extend through holder 100 to define apertures. In some embodiments, such as shown in FIG. 1C, an indentation 124 may extend through and across retaining portion 114 to create a break in retaining portion 114. A similar indentation or break may be provided though upper anchor portion 110 or lower anchor portion 112 (not shown).

In some embodiments, holder 100 includes one or more protrusions 126. In some embodiments, one or more protrusions 126 are provided to strengthen a portion of holder 100, such as a part of lower anchor portion 112 as illustrated in FIGS. 1A-1C. In the illustrations of FIGS. 1A-1C, eight indentations 122 and one protrusion 126 are shown but it should be appreciated that any suitable number of indentions 122 and/or protrusions 126 may be formed in holder 100. Additional indentations 122 and/or protrusions 126 may be included for aesthetic benefit.

In some embodiments, holder 100 may be provided in a range of sizes so as to fit a range of ear sizes, where upper anchor portion 110 is sized to fit over a helix and upper half of an outer ear, lower anchor portion 112 is sized to fit over a lobule of an ear and retaining portion 114 is positioned so that a portion of retaining portion 114 will prevent egress of an earphone in place on the ear. In some embodiments, holder 100 has a height of 4.2 cm and a width of 3.5 cm, however additional sizes are considered within the scope of the innovation. In some embodiments, holder 100 or portions thereof are formed from silicone. In some embodiments, holder 100 or portions thereof are formed from latex. In some embodiments, holder 100 or portions thereof are formed from spandex. In some embodiments, holder is formed from a combination of materials.

FIGS. 2A-2E show illustrations of an earphone holder for placing on an ear according to some embodiments. As shown in FIGS. 2A-2E, holder 100, as described above with reference to FIGS. 1A-1C is configured so as to prevent an earphone 102 from falling out of an ear 104 when the holder 100 is placed on the ear 104 over the earphone 102.

Figure 2A:
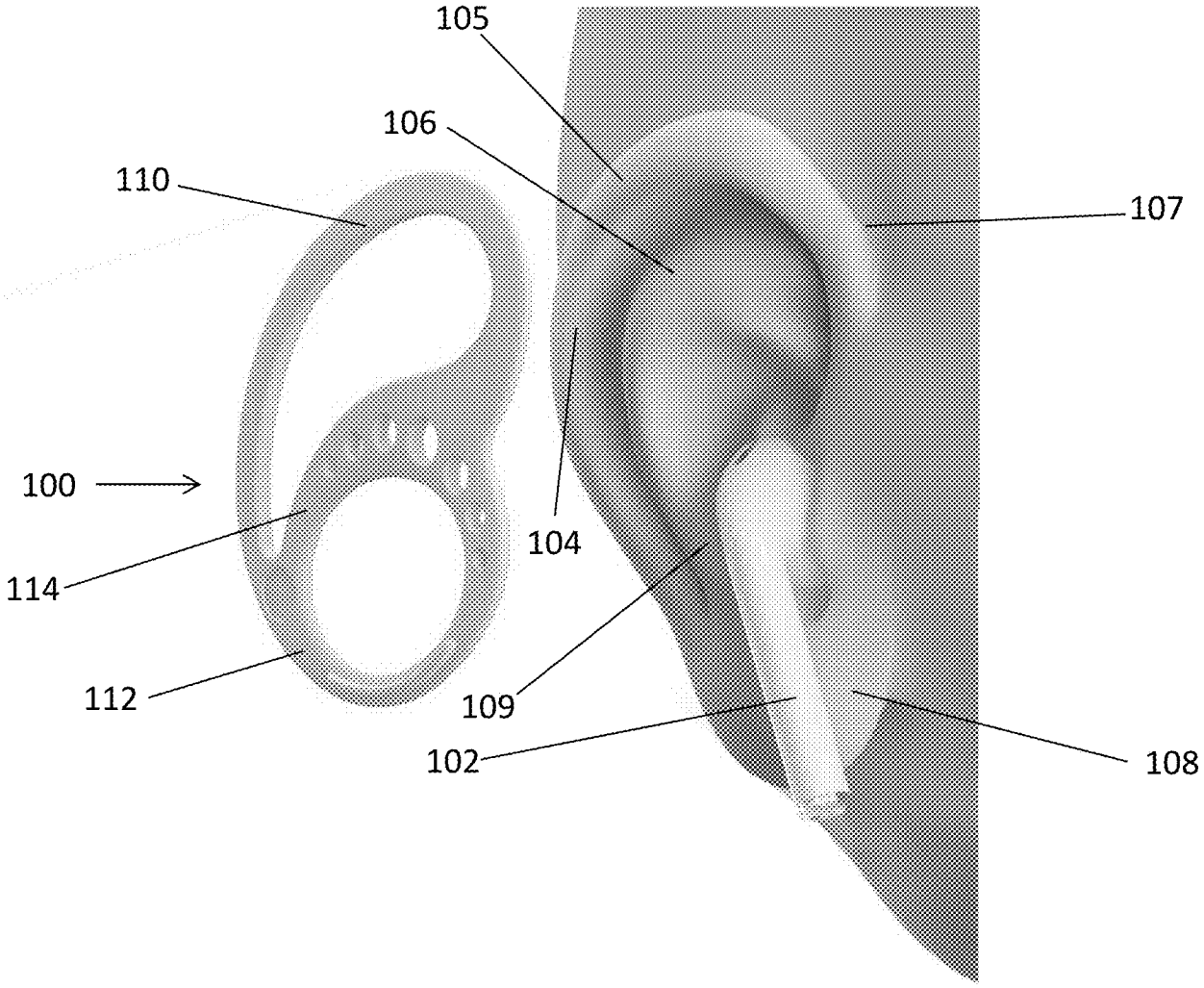
FIGS. 2A-2E show illustrations of an earphone holder for placing on an ear according to some embodiments.
Figure 2B:
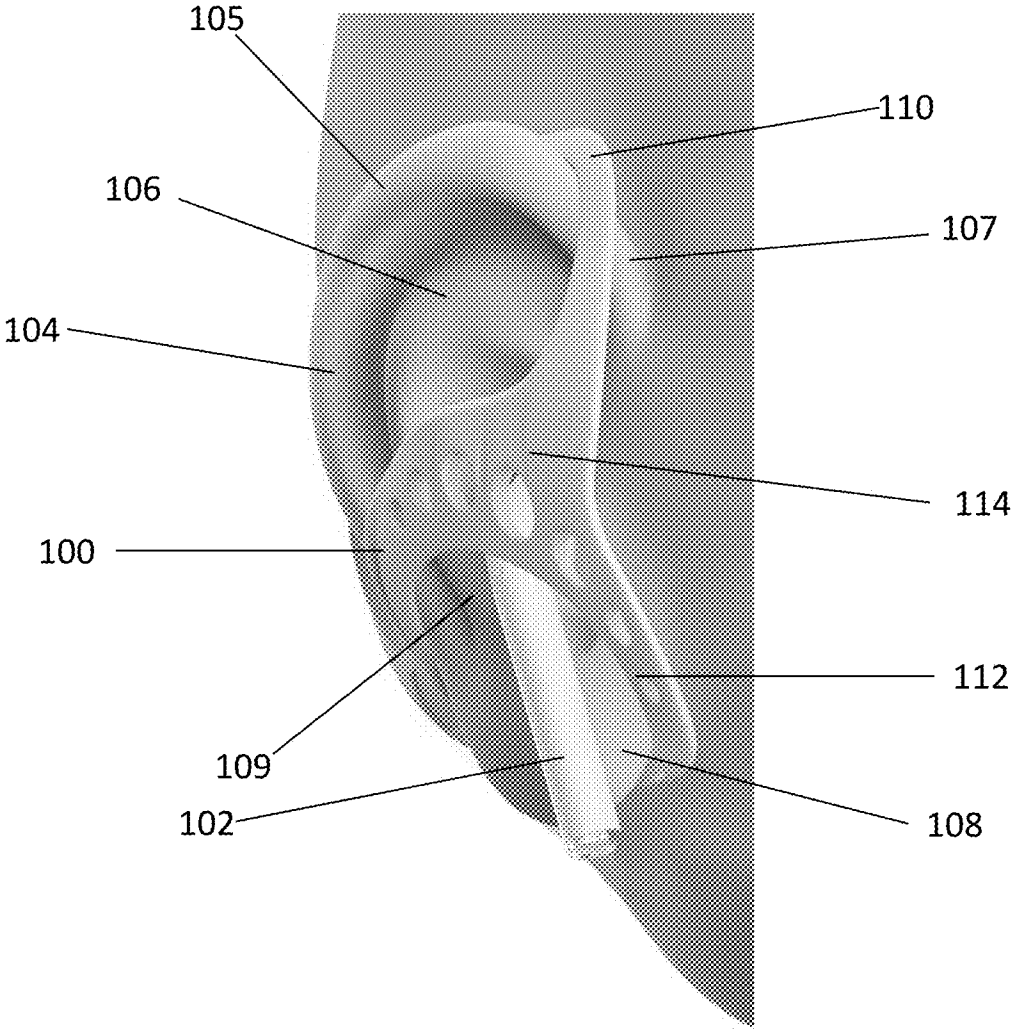

As shown in FIG. 2B, when holder 100 is positioned on an ear 104, upper anchor portion 110 is placed over the helix (top of outer ear) 105, such that a portion of upper anchor portion 110 fits primarily behind helix 105 and a scapha 106, and lower anchor portion 112 is placed so as to wrap primarily around the lobule 108. When so positioned, holder 100 will wrap around to the front of the ear at two points: at the connection 107 of ear 104 to the head and about two-thirds of the way down the outer ear near the antitragus 109. Holder 100 is preferably proportioned such that, when holder 100 is positioned in the manner shown in FIGS. 2A and 2B, part of retaining portion 114 prevents or impedes egress on earphone 102. In some embodiments, retaining portion 114 makes contact with, and exerts pressure on, a portion of earphone 102 in the direction of the ear canal, to thereby hold earphone 102 in or on ear 104.

Figure 2C:
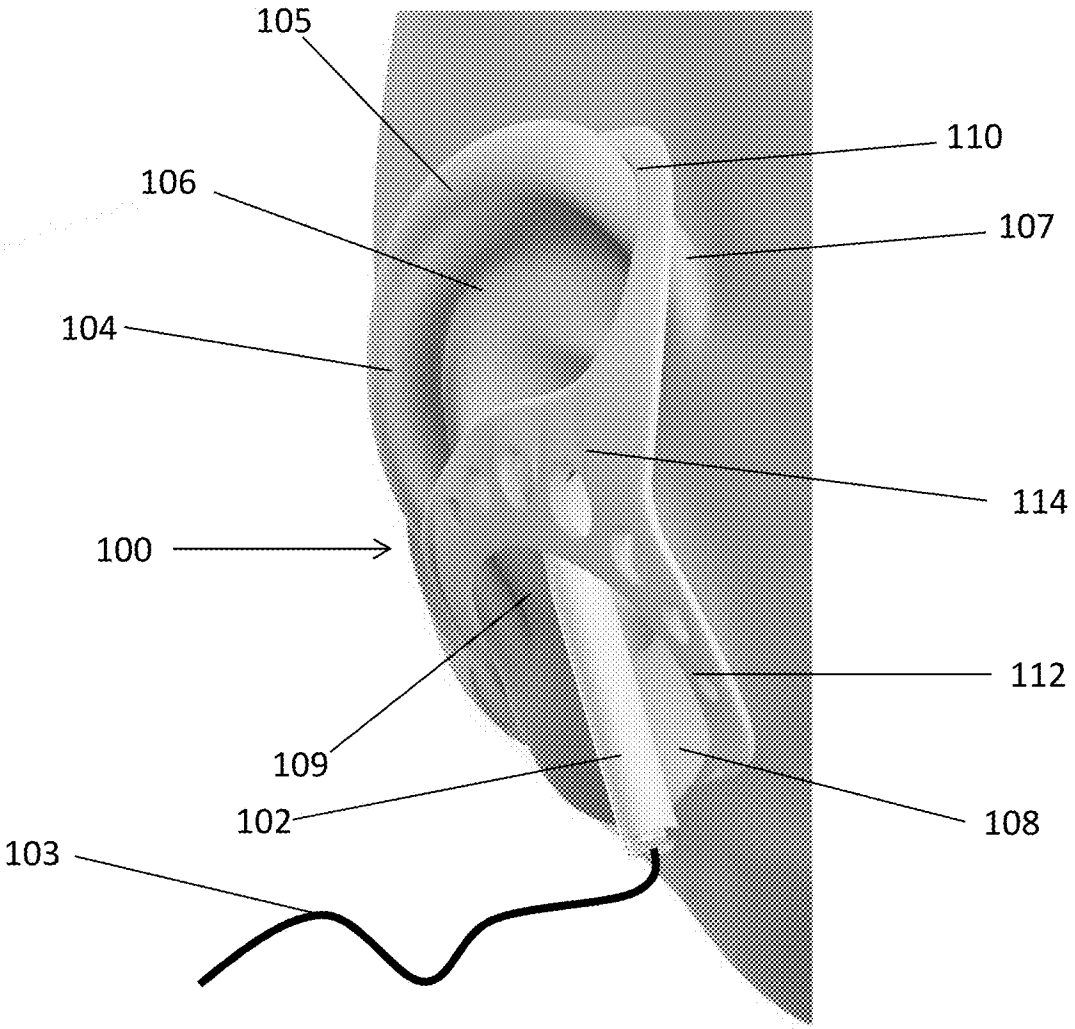
Figure 2D:
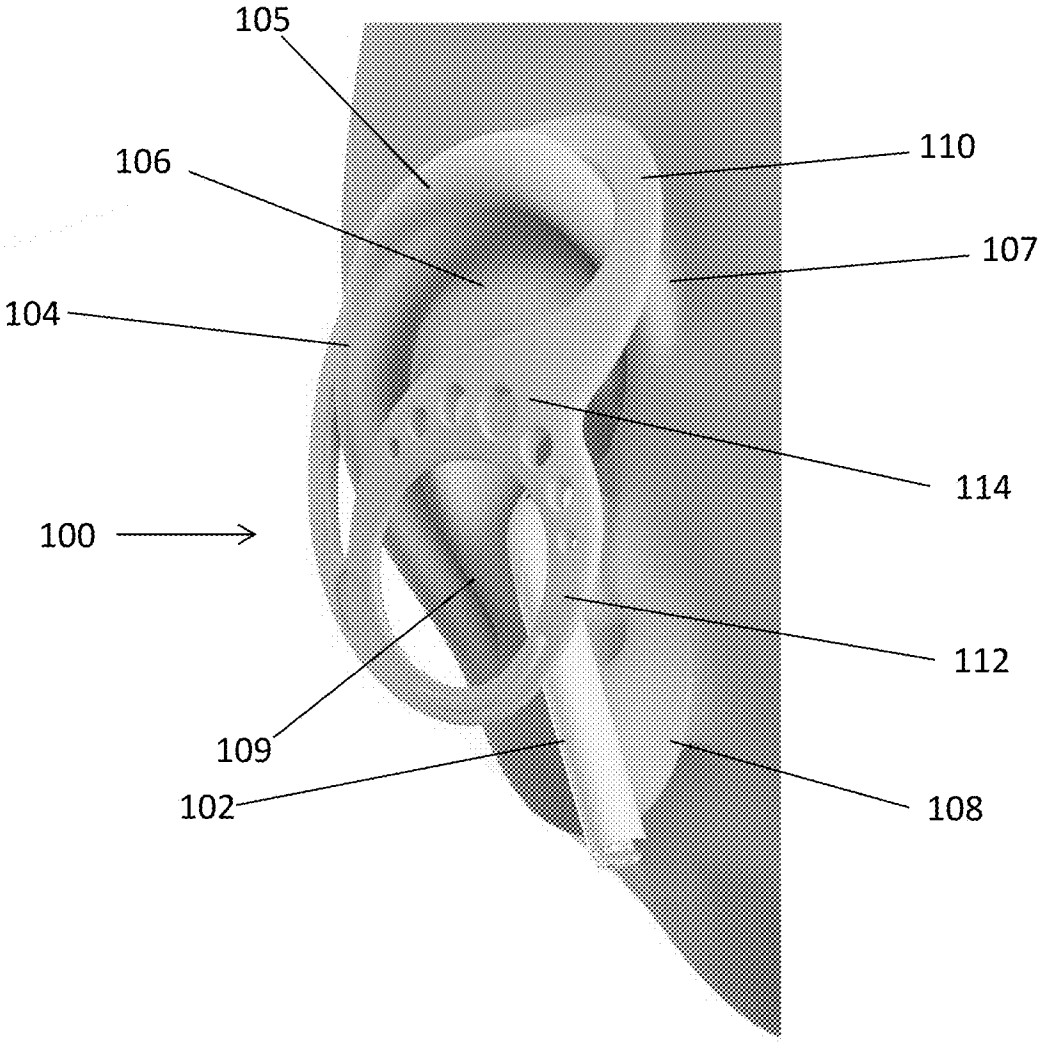
Figure 2E:
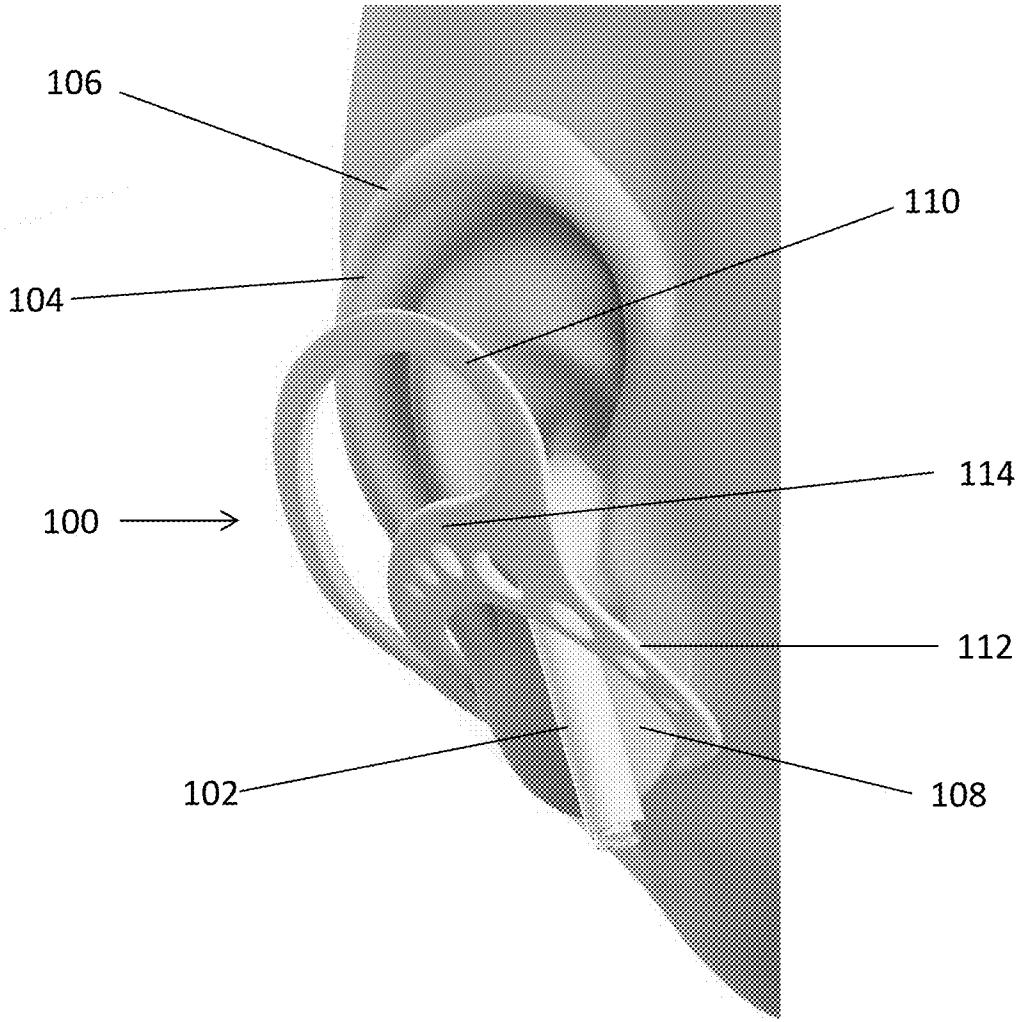

As shown in FIG. 2C, holder 100 may also be used for holding wired earphones 102 in or on ear 104. In some embodiments, when earphone 102 includes a wire 103, earphone 102 is first threaded through one of apertures 118 or 120 before holder 100 is positioned on ear 104. As shown in FIGS. 2D-2E, holder 100 may be placed on ear 104 by first placing upper anchor portion 110 over helix 105 by placing or stretching anchor portion 110 or bending helix 105 through aperture 118, and then placing lower anchor portion 112 over the lobule 108 by placing or stretching anchor portion 112 or bending lobule 108 through aperture 120. Alternatively, holder 100 may be placed on ear 104 by first placing lower anchor portion 112 over lobule 108 by placing or stretching anchor portion 112 or bending lobule 108 through aperture 120, and then placing upper anchor portion 110 over helix 105 by placing or stretching upper anchor portion 110 or bending helix 105 through aperture 118. Removal of holder 110 may also be performed by first removing upper anchor portion 110 and then lower anchor portion 112 from ear 104 or vice versa.

Alternatively, holder 100 may first be positioned on ear 104 as described hereinabove and only then is earphone 102 inserted under retaining portion 114 and into the desired position on or in ear 104.

Unless otherwise defined, all technical and scientific terms used herein have the same meaning as commonly understood by one of ordinary skill in the art. The materials, methods, and examples provided herein are illustrative only and not intended to be limiting.

Throughout this application, various embodiments of this invention may be presented in a range format. It should be understood that the description in range format is merely for convenience and brevity and should not be construed as an inflexible limitation on the scope of the invention. Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

For the sake of clarity, the term "substantially" is used herein to imply the possibility of variations within an acceptable range. According to one example, the term "substantially" used herein should be interpreted to imply possible variation of up to 10% over or under any specified value. According to another example, the term "substantially" used herein should be interpreted to imply possible variation of up to 5% over or under any specified value. According to a further example, the term "substantially" used herein should be interpreted to imply possible variation of up to 2.5% over or under any specified value.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment or implementation are necessary in every embodiment or implementation of the invention. Further combinations of the above features and implementations are also considered to be within the scope of some embodiments or implementations of the invention.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A device comprising: a first anchor portion, a second anchor portion, and a retaining portion positioned between the first anchor portion and the second anchor portion, wherein the device is configured for positioning on an ear over an earphone placed in or on the ear, wherein the retaining portion is configured to prevent egress of the earphone when the device is positioned on an ear, wherein the first anchor portion and the retaining portion define a first aperture, wherein the second anchor portion and retaining portion define a second aperture, wherein the second aperture has a substantially circular shape.

2. The device of claim 1, wherein the retaining portion is configured to exert pressure on the earphone in the direction of an ear canal when the device is positioned on an ear.

3. The device of claim 1, wherein the first anchor portion is configured to fit over a helix of an ear, and wherein the second anchor portion is configured to fit over a lobule of the ear.

4. The device of claim 1, wherein both of the first and second anchor portions comprise a material of sufficient elasticity such that both of the first and second anchor portions are configured to be stretched or bent to fit over one or more portions of the ear.

5. The device of claim 4, configured such that the device remains on the ear when both of the first and second anchor portions are stretched or bent to fit over one or more portions of the ear.

6. The device of claim 1, wherein both of the first and second anchor portions comprise a substantially rigid material to enable different portions of the ear to be bent to extend through the first and second anchor portions.

7. The device of claim 1, wherein the first anchor portion, the second anchor portion, and the retaining portion comprise an elastic material.

8. The device of claim 1, wherein at least one of the portions further comprises an indentation.

9. The device of claim 8, wherein the indentation extends through the device to define an aperture.

10. The device of claim 6, wherein an aperture extends across one of the first anchor portion, the second anchor portion, or the retaining portion to form a break.

11. The device of claim 1, wherein at least one of the portions further comprises a protrusion.

12. The device of claim 1, wherein the device is substantially identical on both sides.

13. The device of claim 1, wherein the device is not identical on both sides.

14. The device of claim 1, wherein the first aperture has a substantially bent teardrop shape.

15. The device of claim 1, wherein the first or second aperture is configured to accommodate a wire of a wired earphone.

16. The device of claim 1, wherein at least one of the portions comprises one or more of silicone, latex or spandex.

* * * * *